US006602847B2

(12) United States Patent
Emery et al.

(10) Patent No.: US 6,602,847 B2
(45) Date of Patent: Aug. 5, 2003

(54) LAUNDRY TREATMENT GRANULE AND DETERGENT COMPOSITION CONTAINING LAUNDRY TREATMENT GRANULE

(75) Inventors: William Derek Emery, Wirral (GB); Christopher Clarkson Jones, Wirral (GB)

(73) Assignee: Unilever Home & Personal Care, USA division of Conopco, Inc., Greenwich, CT (US)

( * ) Notice: Subject to any disclaimer, the term of this patent is extended or adjusted under 35 U.S.C. 154(b) by 193 days.

(21) Appl. No.: 09/821,621

(22) Filed: Mar. 29, 2001

(65) Prior Publication Data

US 2001/0039249 A1 Nov. 8, 2001

(30) Foreign Application Priority Data

Mar. 29, 2000 (GB) ..... 0007661

(51) Int. Cl.[7] ..... C11D 3/37
(52) U.S. Cl. ..... 510/446; 510/471
(58) Field of Search ..... 510/471, 470, 510/441, 446

(56) References Cited

U.S. PATENT DOCUMENTS

| | | | | |
|---|---|---|---|---|
| 3,756,966 | A | 9/1973 | Lamberti | |
| 4,235,735 | A | 11/1980 | Marco et al. | |
| 6,288,022 | B1 * | 9/2001 | Clark et al. | 510/470 |
| 6,358,903 | B2 * | 3/2002 | Hopkinson et al. | 510/375 |
| 6,455,489 | B2 * | 9/2002 | Bijsterbosch et al. | 510/471 |

FOREIGN PATENT DOCUMENTS

| | | |
|---|---|---|
| WO | 97/38016 | 10/1997 |
| WO | 98/29528 | 9/1998 |
| WO | 99/14245 | 3/1999 |
| WO | 00/18860 | 6/2000 |
| WO | 00/42144 | 7/2000 |

* cited by examiner

*Primary Examiner*—John Hardee
(74) *Attorney, Agent, or Firm*—Alan A. Bornstein

(57) ABSTRACT

In order to protect a fabric rebuild polymer which undergoes, during a laundry treatment process, a chemical change by which the affinity of the rebuild agent for the fabric is increased, from hydrolysis on storage, the fabric rebuild agent is in the form of a granule comprising fabric rebuild agent, acidic binder, neutral filler and optionally acidic filler. The granule can be post-dosed to a powder detergent composition.

22 Claims, No Drawings

LAUNDRY TREATMENT GRANULE AND DETERGENT COMPOSITION CONTAINING LAUNDRY TREATMENT GRANULE

TECHNICAL FIELD

The present invention relates to a laundry treatment granule. It further extends to granular detergent compositions comprising a first granule, which comprises detergent active, and a second granule, which is according to the invention. The invention further extends to a process for manufacturing a laundry treatment granule according to the invention.

BACKGROUND OF THE INVENTION

Repeated washing of garments, particularly those comprising cotton or other cellulosic fibres, causes gradual loss of material from individual fibres and the loss of whole fibres from the fabric. These processes of attrition result in thinning of the fabric, eventually rendering it semi-transparent, more prone to accidental tearing and generally detracting from its original appearance.

Hitherto, there has been no way of minimising this kind of damage except by employing less frequent washing and use of less harsh detergent products and/or wash conditions, which obviously tends to less effective cleaning.

In laundry cleaning or treatment products, it is essential for some ingredients to be deposited onto and adhere to the fabric for them to deliver their beneficial effects. Typical examples are fabric conditioners or softeners. Nevertheless, the benefits conferred by such conventional materials do not include rebuilding the fabric. It has now been found possible to include in laundry products, agents which deposit cellulose or cellulose-like materials onto the fabric to at least partially replace the lost material of the fibre.

Our copending application WO 00/18860 describes a wide general class of fabric rebuild agents, which can rebuild fabric during a laundry operation. It has been found that, during storage of the formulation, normal conditions of humidity, temperature and alkalinity within the package are such that the fabric rebuild agent degrades so that it can become insoluble and ineffective. The present inventors have found that this problem can be overcome by formulating the fabric rebuild agent into a granule which also comprises acidic binder and a neutral filler. This granule can then be admixed to conventional powder laundry detergent compositions.

DEFINITION OF THE INVENTION

In a first aspect, the present invention provides a laundry treatment granule comprising:

(a) 50–90% by weight based on the granule of a water-soluble or water-dispersible rebuild agent for deposition onto a fabric during a laundry treatment process wherein the rebuild agent undergoes during the laundry treatment process, a chemical change by which change the affinity of the rebuild agent for the fabric is increased, said chemical change resulting in the loss or modification of one or more groups covalently bonded to be pendant to a polymeric backbone of the rebuild agent via an ester linkage, the ester-linked group(s) being selected from monocarboxylic acid esters, (b) 0.3–10% by weight based on the granule of acidic binder, and (c) 5–30% by weight based on the granule of neutral filler.

In a second aspect, the present invention provides a laundry treatment granule comprising:

(a) 50–90% by weight based on the granule of a water-soluble or water-dispersible rebuild agent for deposition onto a fabric during a laundry treatment process wherein the rebuild agent undergoes during the laundry treatment process, a chemical change by which change the affinity of the rebuild agent for the fabric is increased, the chemical change occurring in or to a group or groups covalently bonded to be pendant on a polymeric backbone of the rebuild agent and which backbone comprises cellulose units or other β-1,4 linked polysaccharide units, the average degree of substitution of the total of all groups pendant on the saccharide rings of the backbone being from 0.3 to 3, preferably from 0.4 to 1, more preferably from 0.5 to 0.75, most preferably from 0.6 to 0.7;

(b) 0.3–10% by weight based on the granule of acidic binder, and (c) 5–30% based on the granule of neutral filler.

Further, the present invention extends to a process for the manufacture of a granule according to the invention, comprising mixing fabric rebuild agent, acidic binder and neutral filler in a high speed mixer/granulator. Further, the present invention extends to a granular laundry detergent composition, comprising a first granule which comprises a laundry detergent active and a second granule, which is a granule according to the present invention.

DEFINITIONS

Definition of the Invention

Throughout this specification, "average degree of substitution" refers to the number of substituted pendant groups per saccharide ring, averaged over all saccharide rings of the rebuild agent. Each saccharide ring prior to substitution has three —OH groups and therefore, an average degree of substitution of 3 means that each of these groups on all molecules of the sample, bears a substituent.

By ester linkage is meant that the hydrogen of an —OH group has been replaced by a substituent such as R'—CO—, $R'SO_2$— etc to form a carboxylic acid ester, sulphonic acid ester (as appropriate) etc together with the remnant oxygen attached to the saccharide ring. In some cases, the group R' may for example contain a heteroatom, e.g. as an —NH— group, attached to the carbonyl, sulphonyl etc group, so that the linkage as a whole could be regarded as a urethane etc linkage. However, the term ester linkage is still to be construed as encompassing these structures. The compositions according to the second aspect are not limited to those incorporating rebuild agents incorporating monocarboxylic acid ester linkages.

Optionally, the rebuild agent used in the granule may be as defined for both the first and second aspects of the invention, simultaneously.

DETAILED DESCRIPTION OF THE INVENTION

The Rebuild Agent

The exact mechanism by which the rebuild agents exert their effect is not fully understood. Whether or not they can repair thinned or damaged fibres is not known. However, they are capable of replacing lost fibre weight with deposited and/or bonded material, usually of cellulosic type. This can provide one or more advantages such as repair or rebuilding of the fabric, strengthening of the textile or giving it enhanced body or smoothness, reducing its transparency, reducing fading of colours, improving the appearance of the fabric or of individual fibres, improved comfort during garment wear, dye transfer inhibition, increased stiffness, anti-wrinkle, effect and ease of ironing.

In the case of those rebuild agents having a cellulose backbone and pendant ester groups, without being bound by any particular theory or explanation, the inventors have conjectured that the mechanism of deposition is as follows.

Cellulose is substantially insoluble in water. Attachment of the ester groups causes disruption of the hydrogen bonding between rings of the cellulose chain, thus increasing water solubility or dispersibility. In the treatment liquor, it is believed that the ester groups are hydrolysed, causing the affinity for the fabric to increase and the polymer to be deposited on the fabric.

The rebuild agent material used in the present invention is water-soluble or water-dispersible in nature and in a preferred form comprises a polymeric backbone having one or more pendant groups which undergo the chemical change to cause an increase in affinity for fabric.

The weight average molecular weight ($M_w$) of the rebuild agent (as determined by GPC) may typically be in the range of 500 to 2,000,000 for example 1,000 to 1,500,000. Preferably though, it is from 1,000 to 100,000, more preferably from 5,000 to 50,000, especially from 10,000 to 15,000.

By water-soluble, as used herein, what is meant is that the material forms an isotropic solution on addition to water or another aqueous solution.

By water-dispersible, as used herein, what is meant is that the material forms a finely divided suspension on addition to water or another aqueous solution. Preferably though, the term "water-dispersible" means that the material, in water at pH 7 and at 25° C., produces a solution or a dispersion having long-term stability.

By an increase in the affinity of the material for the fabric upon a chemical change, what is meant is that at some time during the treatment process, the amount of material that has been deposited is greater when the chemical change is occurring or has occurred, compared to when the chemical change has not occurred and is not occurring, or is occurring more slowly, the comparison being made with all conditions being equal except for that change in the conditions which is necessary to affect the rate of chemical change.

Deposition includes adsorption, cocrystallisation, entrapment and/or adhesion.

The Polymeric Backbone

For the first aspect of the invention, it is especially preferred that the polymeric backbone is of a similar chemical structure to that of at least some of the fibres of the fabric onto which it is to be deposited.

For example, if the fabric is cellulosic in nature, e.g. cotton, the polymeric backbone is preferably cellulose or a cellulose derivative or a another β-1,4-linked polysaccharide having an affinity for cellulose, such as mannan and glucomannan. This is essential in the case of the second aspect of the invention. The average degree of substitution on the polysaccharide of the pendant groups which undergo the chemical change (plus any non-functional pendant groups which may be present) is preferably (for compositions according to the first aspect of the invention) or essential (for compositions according to the second aspect of the invention) from 0.3 to 3, more preferably from 0.4 to 1. Still more preferred is a degree of substitution of from 0.5 to 0.75 and yet more preferred is 0.6–0.7.

The polysaccharide may be straight or branched. Many naturally occurring polysaccharides have at least some degree of branching, or at any rate, at least some saccharide rings are in the form of pendant side groups (and therefore are not in themselves counted in the degree of substitution) on a main polysaccharide backbone.

A polysaccharide comprises a plurality of saccharide rings, which have pendant hydroxyl groups. The pendant groups can be bonded chemically or by other bonding mechanism, to these hydroxyl groups by any means described hereinbelow. The "average degree of substitution" means the average number of pendant groups per saccharide ring for the totality of polysaccharide molecules in the sample and is determined for all saccharide rings whether they form part of a linear backbone or are themselves, pendant side groups in the polysaccharide.

Other polymeric backbones suitable as according to the present invention include those described in Hydrocolloid Applications, A. Nussinswitch, Blackie 1997. *Pendant Groups which undergo the Chemical Change*

The chemical change which causes the increased fabric is preferably hydrolysis, perhydrolysis or bond-cleavage, optionally catalysed by an enzyme or another catalyst. Hydrolysis of ester-linked groups is most typical. However, preferably this change is not merely protonation or deprotonation, i.e. a pH induced effect.

The chemical change occurs in or to a group covalently bonded to a polymeric backbone, especially, the loss of one or more such groups. These group(s) is/are pendant on the backbone. In the case of the first aspect of the invention these are ester-linked groups based on monocarboxylic acids.

Preferred for use in the first aspect of the invention are cellulosic polymers of formula (I):

(I)

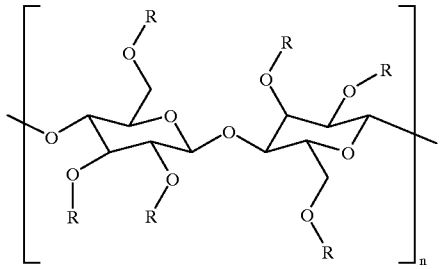

wherein at least one or more R groups of the polymer are independently selected from groups of formulae:

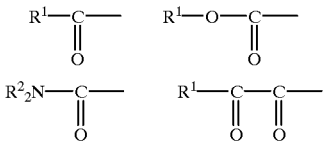

wherein each $R^1$ is independently selected from $C_{1-20}$ (preferably $C_{1-6}$)alkyl, $C_{2-20}$ (preferably $C_{2-6}$) alkenyl (e.g. vinyl) and $C_{5-7}$ aryl (e.g. phenyl) any of which is optionally substituted by one or more substituents independently selected from $C_{1-4}$ alkyl, $C_{1-12}$ (preferably $C_{1-4}$) alkoxy, hydroxyl, vinyl and phenyl groups; and each $R^2$ is independently hydrogen or a group $R^1$ as hereinbefore defined.

The second aspect of the invention is not limited to (but may include) use of rebuild agents incorporating ester linkages based on monocarboxylic acids.

Preferred for use in the second aspect of the invention are cellulosic polymers of formula (II):

(II)

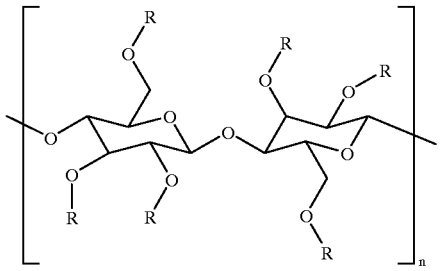

wherein at least one or more R groups of the polymer are independently selected from groups of formulae:

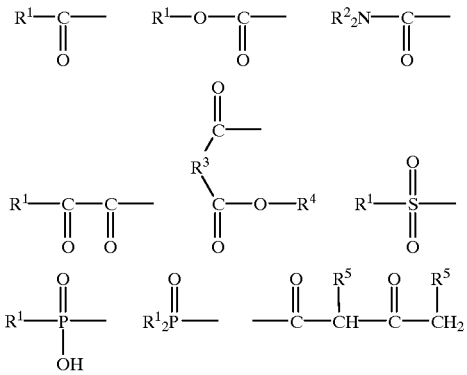

wherein each $R^1$ is independently selected from $C_{1-20}$ (preferably $C_{1-6}$) alkyl, $C_{2-20}$ (preferably $C_{2-6}$) alkenyl (e.g. vinyl) and $C_{5-7}$ aryl (e.g. phenyl) any of which is optionally substituted by one or more substituents independently selected from $C_{1-4}$ alkyl, $C_{1-2}$ (preferably $C_{1-4}$) alkoxy, hydroxyl, vinyl and phenyl groups;

each $R^2$ is independently selected from hydrogen and groups $R^1$ as hereinbefore defined;

$R^3$ is a bond or is selected from $C_{1-4}$ alkylene, $C_{2-4}$ alkenylene and $C_{5-7}$ arylene (e.g. phenylene) groups, the carbon atoms in any of these being optionally substituted by one or more substituents independently selected from $C_{1-2}$ (preferably $C_{1-4}$) alkoxy, vinyl, hydroxyl, halo and amine groups;

each $R^4$ is independently selected from hydrogen, counter cations such as alkali metal (preferably Na) or ½Ca or ½Mg, and groups $R^1$ as hereinbefore defined;

wherein each $R_5$ is independently selected from the group consisting of H, $C_1$–$C_{20}$ alkyl, $C_5$–$C_7$ cycloalkyl, $C_7$–$C_{20}$ arylalkyl, $C_7$–$C_{20}$ alkylaryl, substituted alkyl, hydroxyalkyl, $(R_6)_2$N-alkyl, and $(R_6)_3$N-alkyl, where $R_6$ is independently selected from the group consisting of H, $C_1$–$C_{20}$ alkyl, $C_5$–$C_7$ cycloalkyl, $C_7$–$C_{20}$ arylalkyl, $C_7$–$C_{20}$ alkylaryl, aminoalkyl, alkylaminoalkyl, dialkylaminoalkyl, piperidinoalkyl, morpholinoalkyl, cycloaminoalkyl and hydroxyalkyl;

groups R which together with the oxygen atom forming the linkage to the respective saccharide ring forms an ester or hemi-ester group of a tricarboxylic- or higher polycarboxylic- or other complex acid such as citric acid, an amino acid, a synthetic amino acid analogue or a protein.

For the avoidance of doubt, as already mentioned, in both formula (I) and formula (II) the groups R do not all have to have the same structure and some of them may have structures which are different to the structures of groups which undergo a chemical change. For example, one or more R groups may simply be hydrogen or an alkyl group.

In the case of formula (II), some preferred R groups may be independently selected from one or more of methanesulphonate, toluene, sulphonate, groups and hemiester groups of fumaric, malonic, itaconic, oxalic, maleic, succinic, tartaric, glutamic, aspartic and malic acids.

In the case of formula (I) and formula (II), they may be independently selected from one or more of acetate, propanoate, trifluroacetate, 2-(2-hydroxy-1-oxopropoxy) propanoate, lactate, glycolate, pyruvate, crotonate, isovalerate, cinnamate, formate, salicylate, carbamate, methylcarbamate, benzoate and gluconate groups.

Particularly preferred are cellulose monoacetate, cellulose hemisuccinate, and cellulose 2-(2-hydroxy-1-oxopropoxy) propanoate. The term cellulose monoacetate is used herein to denote those acetates with the degree of substitution of 1 or less.

Other Pendant Groups

As mentioned above, preferred (for the first aspect of the invention) or essential (for the second aspect of the invention) are degrees of substitution for the totality of all pendant substituents in the following order of increasing preference: from 0.3 to 3, from 0.4 to 1, from 0.5 to 0.75, from 0.6 to 0.7. However, as well as the groups which undergo the chemical change, pendant groups of other types may optionally be present, i.e. groups which do not undergo a chemical change to enhance fabric affinity.

Within that class of other groups is the sub-class of groups for enhancing the solubility of the rebuild agent (e.g. groups which are, or contain one or more free carboxylic acid/salt and/or sulphonic acid/salt and/or sulphate groups).

Examples of solubility enhancing substituents include carboxyl, sulphonyl, hydroxyl, (poly)ethyleneoxy-and/or (poly)propyleneoxy-containing groups, as well as amine groups.

The other pendant groups preferably constitute from 0% to 65%, more preferably from 0% to 10% (e.g. from 0% to 5%) of the total number of pendant groups. The minimum number of other pendant groups may, for example be 0.1% or 1% of the total. The water-solubilising groups could comprise from 0% to 100% of those other groups but preferably from 0% to 20%, more preferably from 0% to 10%, still more preferably from 0% to 5% of the total number of other pendant groups.

Synthetic Routes

Those rebuild agents used in the present invention which are not commercially available may be prepared by a number of different synthetic routes, for example:

(1) polymerisation of suitable monomers, for example, enzymatic polymerisation of saccharides, e.g. per S. Shoda, & S. Kobayashi, Makromol. Symp. 1995, 99, 179–184 or oligosaccharide synthesis by orthogonal glycosylation e.g. per H. Paulsen, Angew. Chem. Int. Ed. Engl. 1995, 34, 1432–1434.;

(2) derivatisation of a polymeric backbone (either naturally occurring, especially polysaccharides, especially beta- 1,4-linked polysaccharides, especially cellulose, mannan, glucomannan, galactomannan, xyloglucan; or synthetic polymers) up to the required degree of substitution with functional groups which improve the solubility of the polymer using a reagent (especially acid halides, especially carboxylic acid halides, anhydrides, carboxylic acid anhydrides, carboxylic acids or, carbonates) in a solvent which either dissolves the backbone, swells the backbone, or does not swell the backbone but dissolves or swells the product;

(3) hydrolysis of polymer derivatives (especially esters) down to the required degree of substitution; or (4) a combination of any two or more of routes (1)–(3).

The degree and pattern of substitution from routes (1) or (2) may be subsequently altered by partial removal of functional groups by hydrolysis or solvolysis or other cleavage. Relative amounts of reactants and reaction times can also be used to control the degree of substitution. In addition, or alternatively, the degree of polymerisation of the backbone may be reduced before, during, or after the derivatisation with functional groups. The degree of polymerisation of the backbone may be increased by further polymerisation or by cross linking agents before, during, or after the derivatisation step.

Cellulose esters of hydroxyacids can be obtained using the acid anhydride, typically in acetic acid solution at 20 30° C. When the product has dissolved the liquid is poured into water. Glycollic and lactic esters can be made in this way.

Cellulose glycollate may also be obtained from cellulose chloracetate (B.P. 320,842) by treating 100 parts with 32 parts of NaOH in alcohol added in small portions.

An alternative method of preparing cellulose esters consists in the partial displacement of the acid radical in a cellulose ester by treatment with another acid of higher ionisation constant (F.P. 702,116). The ester is heated at about 100° with the acid which, preferably, should be a solvent for the ester. By this means cellulose acetate-oxalate, tartrate, maleate, pyruvate, salicylate and phenylglycollate have been obtained, and from cellulose tribenzoate a cellulose benzoate-pyruvate. A cellulose acetate-lactate or acetate-glycollate could be made in this way also. As an example cellulose acetate (10 g) in dioxan (75 ml) containing oxalic acid (10 g) is heated at 100° for 2 hours under reflux.

Multiple esters are prepared by variations of this process. A simple ester of cellulose, e.g. the acetate, is dissolved in a mixture of two (or three) organic acids, each of which has an ionisation constant greater than that of acetic acid ($1.82\times 10^{-5}$). With solid acids suitable solvents such as propionic acid, dioxan and ethylene dichloride are used. If a mixed cellulose ester is treated with an acid this should have an ionisation constant greater than that of either of the acids already in combination. Thus:

A cellulose acetate-lactate-pyruvate is prepared from cellulose acetate, 40 percent. acetyl (100 g), in a bath of 125 ml pyruvic acid and 125 ml of 85 percent. lactic acid by heating at 1000 for 18 hours. The product is soluble in water and is precipitated and washed with ether-acetone. M.p. 230–250°.

Acidic Binder

By an acidic binder, it is meant a composition which is capable of acting as a binder for a granule, which material gives a pH when dissolved or dispersed in an aqueous solution at a level of 1 g/l at 20° C. of less than 6.

Suitably, the acidic binder is a polymeric material. Suitably, it is a homo or copolymer of monomers selected from the group consisting of acrylic acid, methacrylic acid, ethacrylic acid, alpha-chloro-acrylic acid, crotonic-acid, cinnamic acid, maleic acid, itaconic acid, citraconic acid, mesaconic acid, glutaconic acid, aconitic acid, fumaric acid, and mixtures thereof.

Polymers and copolymers of acrylic acid, methacrylic acid and maleic acid are particularly preferred, such as Sokalan CP45 (trade mark).

The acidic binder may also comprise a long chain monocarboxylic acid, preferably a $C_8$–$C_{20}$ alkyl fatty acid.

Neutral Filler

By neutral filler is meant a solid material suitable for bulking out the granule and which gives a pH, when dissolved or dispersed in an aqueous solution at a level of 1 g/l at 20° C. in the range 8–6.

Suitably, the inert filler comprises sodium sulphate, sodium, acetate or sodium chloride.

Acidic Filler

The granule of the present invention may optionally comprise acidic filler. Acidic filler is defined as a material, suitable for bulking out a granule, which, when dissolved or dispersed in an aqueous solution at a level of 1 g/l at 20° C. gives a pH below 6. Suitable acidic filers comprise acidic silica and mono or polycarboxylic acids such as malonic acid, succinic acid, glutaric acid, adipic acid, maleic acid, tartaric acid, citric acid or mixtures thereof.

Mixing Ratios

Granules of the present invention preferably comprise 50–75% by weight of the fabric rebuild agent, more preferably 60–70% by weight. The granule preferably comprises 7–25% by weight of neutral filler, more preferably 10–20% by weight of neutral filler. The granule may comprise 5–30% by weight of acidic filler, more preferably 10–20% by weight. Acidic binder is preferably present at a level in the range 0.4–5.0% by weight, more preferably 0.5–1.0% by weight.

Processing

The granule of the present invention may be prepared by mixing the components in a high speed mixer/granulator. Suitable apparatus is described in EP-A-0340013, EP-A-0367339, EP-A-0390251 and EP-A-0420317. The components may be added into the mixer/granulator in any suitable order. Liquid, such as water, may be added to the mixer to act as a granulating agent if necessary.

Laundry Detergent Compositions

The granule of the present invention comprising rebuild agent may be included, according to the third aspect of the invention, in a granular detergent composition. The granule of the present invention is suitably mixed with the first granule at a weight ratio in the range 200:1 to 20:1, more preferably 100:1 to 50:1. The granule of the present invention may be included at such a level as to give an overall content of fabric rebuild agent in the detergent composition in the range 0.01% to 10%, more preferably 0.25% to 2.5%.

The compositions of the present invention are preferably laundry compositions, especially main wash (fabric washing) compositions.

The detergent compositions of the invention contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The detergent compositions of the invention may contain linear alkylbenzene sulphonate, particularly linear alkylbenzene sulphonates having an alkyl chain length of $C_8$–$C_{15}$. It is preferred if the level of linear alkylbenzene sulphonate is from 0 wt % to 30 wt %, more preferably 1 wt % to 25 wt %, most preferably from 2 wt % to 15 wt %.

The detergent compositions of the invention may additionally or alternatively contain one or more other anionic surfactants in total amounts corresponding to percentages quoted above for alkyl benzene sulphonates. Suitable anionic surfactants are well-known to those skilled in the art. These include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The detergent compositions of the invention may contain non-ionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of total non-ionic surfactant is from 0 wt % to 30 wt %, preferably from 1 wt % to 25 wt %, most preferably from 2 wt % to 15 wt %.

Another class of suitable surfactants comprises certain mono-alkyl cationic surfactants useful in main-wash laundry compositions. Cationic surfactants that may be used include quaternary ammonium salts of the general formula $R_1R_2R_3R_4N^+X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Detergent compositions suitable for use in most automatic fabric washing machines generally contain anionic non-soap surfactant, or non-ionic surfactant, or combinations of the two in any suitable ratio, optionally together with soap.

Any conventional fabric conditioning agent may be used in the detergent compositions of the present invention. The conditioning agents may be cationic or non-ionic. If the fabric conditioning compound is to be employed in a main wash detergent composition the compound will typically be non-ionic. If used in the rinse phase, they will typically be cationic. They may for example be used in amounts from 0.5% to 35%, preferably from 1% to 30% more preferably from 3% to 25% by weight of the composition.

Preferably the fabric conditioning agent has two long chain alkyl or alkenyl chains each having an average chain length greater than or equal to $C_{16}$. Most preferably at least 50% of the long chain alkyl or alkenyl groups have a chain length of $C_{18}$ or above.

It is preferred if the long chain alkyl or alkenyl groups of the fabric conditioning agents are predominantly linear.

The fabric conditioning agents are preferably compounds that provide excellent softening, and are characterised by a chain melting $L\beta$ to $L\alpha$ transition temperature greater than 25° C., preferably greater than 35° C., most preferably greater than 45° C. This $L\beta$ to $L\alpha$ transition can be measured by DSC as defined in Handbook of Lipid Bilayers, D Marsh, CRC Press, Boca Raton, Fla., 1990 (pages 137 and 337).

Substantially insoluble fabric conditioning compounds in the context of this invention are defined as fabric conditioning compounds having a solubility less than $1\times10^{-3}$ wt % in demineralised water at 20° C. Preferably the fabric softening compounds have a solubility less than $1\times10^{-4}$ wt %, most preferably less than $1\times10^{-8}$ to $1\times10^{-6}$. Preferred cationic fabric softening agents comprise a substantially water insoluble quaternary ammonium material comprising a single alkyl or alkenyl long chain having an average chain length greater than or equal to $C_{20}$ or, more preferably, a compound comprising a polar head group and two alkyl or alkenyl chains having an average chain length greater than or equal to $C_{14}$.

Preferably, the cationic fabric softening agent is a quaternary ammonium material or a quaternary ammonium material containing at least one ester group. The quaternary ammonium compounds containing at least one ester group are referred to herein as ester-linked quaternary ammonium compounds.

As used in the context of the quarternary ammonium cationic fabric softening agents, the term ester group, includes an ester group which is a linking group in the molecule.

It is preferred for the ester-linked quaternary ammonium compounds to contain two or more ester groups. In both monoester and the diester quaternary ammonium compounds it is preferred if the ester group(s) is a linking group between the nitrogen atom and an alkyl group. The ester groups(s) are preferably attached to the nitrogen atom via another hydrocarbyl group.

Also preferred are quaternary ammonium compounds containing at least one ester group, preferably two, wherein at least one higher molecular weight group containing at least one ester group and two or three lower molecular weight groups are linked to a common nitrogen atom to produce a cation and wherein the electrically balancing anion is a halide, acetate or lower alkosulphate ion, such as chloride or methosulphate. The higher molecular weight substituent on the nitrogen is preferably a higher alkyl group, containing 12 to 28, preferably 12 to 22, e.g. 12 to 20 carbon atoms, such as coco-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of the said lower molecular weight substituents may include an aryl moiety or may be replaced by an aryl, such as benzyl, phenyl or other suitable substituents.

Preferably the quaternary ammonium material is a compound having two $C_{12}$–$C_{22}$ alkyl or alkenyl groups connected to a quaternary ammonium head group via at least one ester link, preferably two ester links or a compound comprising a single long chain with an average chain length equal to or greater than $C_{20}$.

More preferably, the quaternary ammonium material comprises a compound having two long chain alkyl or alkenyl chains with an average chain length equal to or greater than $C_{14}$. Even more preferably each chain has an average chain length equal to or greater than $C_{16}$. Most preferably at least 50% of each long chain alkyl or alkenyl group has a chain length of $C_{18}$. It is preferred if the long chain alkyl or alkenyl groups are predominantly linear.

The detergent compositions of the invention will generally also contain one or more detergency builders. The total amount of detergency builder in the detergent compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The detergent compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8–1.5 $Na_2O$. $Al_2O_3$. 0.8–6 $SiO_2$ These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Detergent compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium noanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. examples of such peracids can be found in U.S. Pat. No. 4,686,063 and U.S. Pat. No. 5,397,501 (Unilever). A preferred example is the imido peroxycarboxylic class of peracids described in EP A 325 288, EP A 349 940, DE 382 3172 and EP 325 289. A particularly preferred example is phtalimido peroxy caproic acid (PAP). Such peracids are suitably present at 0.1–12%, preferably 0.5–10%.

A bleach stabiliser (transistor metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

The detergent compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. Subtilis B. licheniformis,* such as the commercially available subtilisins Maxatase (Trade Mark), as supplied by Gist Brocades N.V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

The detergent compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; inorganic salts such as sodium sulphate; lather control agents or lather boosters as appropriate; proteolytic and lipolytic enzymes; dyes; coloured speckles; perfumes; foam controllers; fluorescers and decoupling polymers. This list is not intended to be exhaustive.

It is often advantageous if soil release polymers are present.

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

The present invention will now be explained in more detail by way of the following non-limiting examples.

EXAMPLES

Example 1

Preparation of Cellulose "Monoacetate"

This was prepared by the methods of WO 91/16359

Example 1a 30.0 g of cellulose diacetate (DS 2.45) (the starting cellulose ester), 0.08 g of molybdenum carbonyl (catalyst), 213.6 g of methanol (reactive solvent 1) and 30.0 g of water (reactive solvent 2) are loaded into a 1-liter, steel Parr reactor equipped with a magnetically coupled agitator. The reactor is sealed, then heated to 140° C. The heat-up time is typically 1 to 2 hours. The initial pressure in the reactor is typically 200 500 psi (1379 3447 kPa) nitrogen. The reaction mixture is stirred at 140° C. for 7 hours. Then the reaction mixture is allowed to cool to room temperature, which typically takes 2 to 3 hours. The products are isolated by filtration of the resulting slurry. The reactive solvent, as well as by-products such as methyl acetate, can be recovered from the filtrate by distillation. The product is cellulose monoacetate and the yield is 66%. The key analyses are: DS=0.48; intrinsic viscosity (0.25 g per 100 ml of DMSO)= 0.55.

Example 1b 30.0 g of cellulose diacetate (DS 2.45) (the starting cellulose ester), 0.05 g of molybdenum (VI) oxide and 237.3 g of methanol (reactive solvent) are loaded into a 1-liter, steel Parr reactor equipped with a magnetically coupled agitator. The reactor is sealed, then heated to 155° C. The heat-up time is typically 1 to 2 hours. The initial pressure in the reactor is typically 200 500 psi (1379 3447 kPa) nitrogen. The reaction mixture is stirred at 155° C. for 3 hours. Then the reaction mixture is allowed to cool to room temperature, which typically takes 2 to 3 hours. The products are isolated by filtration of the resulting slurry. The reactive solvent, as well as certain by-products such as methyl acetate, can be recovered from the filtrate by distillation. The product is cellulose monoacetate and the yield is 87%. The key analyses are: DS=0.50; intrinsic viscosity (0.25 g per 100 ml of DMSO)=1.16.

Example 2

Preparation of Cellulose Hemisuccinate (First Route)

Cellulose hemisuccinate was prepared following B.P. 410,125. A mixture of cellulose (Whatman cellulose powder CF11 which is cotton, 5 g), succinic anhydride (25 g), and pyridine (75 ml) was kept at 65° C. for a week. On pouring into methanol the pyridinium salt of cellulose hemisuccinate was obtained. The crude cellulose hemisuccinate, pyridinium salt, was washed repeatedly with methanol to remove pyridine and unused reactants. The pyridinium salt of cellulose hemisuccinate was converted to the free acid form by driving off the pyridine under vacuum at <95° C.

Infrared spectra of reagents and products were recorded on a Bio-Rad FTS-7 infrared spectrometer using a Graseby Specac (Part #10500) Single Reflection Diamond ATR attachment.

The degree of substitution of cellulose hemisuccinate prepared from cotton fibres was determined by a one-step neutralisation of the carboxylic acid groups and hydrolysis of the ester groups, using an excess of sodium hydroxide, followed by titration of the excess sodium hydroxide with a standard solution of hydrochloric acid, using phenolphthalein as an indicator. The figure thus obtained was 2.8.

The infrared spectrum of the product in its neutralised, sodium salt form, has two distinct bands attributable to the stretching of C═O. The band at 1574 $cm^{-1}$ is attributable to carboxylate anion, a band for which is expected at 1550–1610 $cm^{-1}$. It is therefore reasonable to attribute the other band at 1727 $cm^{-1}$ to ester, a band for which is expected at 1735–1750 $cm^{-1}$. The infrared spectrum is therefore consistent with a hemiester salt.

Example 3

Preparation of Cellulose Hemisuccinate (Route 2)

Cellulose hemisuccinate was prepared following GB-A-410,125. A mixture of cellulose (Avicel PH105, 5 g), succinic anhydride (25 g), and pyridine (75 ml) was kept at 65° C. for a week. On pouring into methanol the pyridinium salt of cellulose hemisuccinate was obtained. The crude cellulose hemisuccinate, pyridinium salt, was washed repeatedly with methanol to remove pyridine and unused reactants.

When this gel was mixed with dilute aqueous sodium hydroxide, it did not immediately dissolve but remained as lumps, but it did slowly dissolve to form a near-optically-clear solution. The fact that the methanol-washed cellulose hemisuccinate was not immediately soluble in dilute aqueous sodium hydroxide indicated that the cellulose hemisuccinate was slightly cross linked.

The methanol-rinsed cellulose hemisuccinate was used to prepare a cellulose hemisuccinate having a lower degree of substitution and with fewer cross links which was water dispersable.

A homogeneous solution was prepared by partially hydrolysing the cellulose hemisuccinate as follows. Cellulose hemisuccinate prepared from microcrystalline cellulose, in the form of a gel of cellulose hemisuccinate, pyridinium salt, dispersed in methanol, was added to 50 ml of stirred 0.1 M NaCl solution at 50° C. 0.1 M NaOH solution was added until the pH was raised to −7.0 (18.0 ml was required). More 0.1 M NaOH solution was added until the pH was raised to −10.5 (3.0 ml was required). This pH was then maintained for 45 minutes by further additions of 0.1 M NaOH solution (4.2 ml was required). The mixture was then cooled to room temperature and neutralised using 1.0 M HCl (0.18 ml was required). After this procedure the solution was only slightly turbid. The polymer was separated from inorganic salts by ultrafiltration (Amicon, Inc.) employing a cellulose triacetate membrane with a molecular weight cut-off of 10,000 (Sartorious SM 145 39).

The degree of substitution of cellulose hemisuccinate prepared from by this route was determined by a one-step neutralisation of the carboxylic acid groups and hydrolysis of the ester groups, using an excess of sodium hydroxide, followed by titration of the excess sodium hydroxide with a standard solution of hydrochloric acid, using phenolphthalein as an indicator. The figure thus obtained was 2.0.

Example 4

Preparation of Cellulose 2-(2-Hydroxy-1-Oxopropoxy)Propanoate

Following the method described in DE 3,322,118 a mixture of 2.33 g lactide (3,6-dimethyl-1,4-dioxane-2,5-dione) and 29.7 g of cellulose solution (obtained by dissolving 14 g of microcrystalline cellulose (Avicel PH105) swollen with 14 g of N,N-dimethylacetamide in a mixture of 200 ml of N,N-dimethylacetamide and 16.8 g of lithium chloride) was treated with 1.5 ml of triethyl amine and stirred at 75° C. for 1.5 hours.

Cellulose 2-(2-hydroxy-1-oxopropoxy)propanoate was isolated by pipetting the reaction mixture into 300 ml of methanol. The product gel was washed with a further two batches of 300 ml of methanol. At this stage the methanol-swollen 2-(2-hydroxy-1-oxopropoxy)propanoate was water soluble.

The cellulose 2-(2-hydroxy-1-oxopropoxy)propanoate was dried in a vacuum oven at room temperature. The dry cellulose 2-(2-hydroxy-1-oxopropoxy)propanoate was partially soluble.

Examples 5–16 are formulation Examples. In each case, the Polymer specified is the material of Example 1.

Example 5

Spray-Dried Powder Dry Mixed with Fabric Rebuild Granule

| Component | % w/w |
|---|---|
| Na PAS | 11.5 |
| Dobanol 25-7 | 6.3 |
| Soap | 2.0 |
| Zeolite | 24.1 |
| SCMC | 0.6 |
| Na Citrate | 10.6 |
| Na Carbonate | 22.0 |
| Silicone Oil | 0.5 |
| Dequest 2066 | 0.4 |
| Sokalan CP5 | 0.9 |
| Savinase 16L | 0.7 |
| Lipolase | 0.1 |

-continued

| Component | % w/w |
|---|---|
| Perfume | 0.4 |
| Water/salts | to 100 |

Fabric Rebuild Granule:

| Component | % w/w |
|---|---|
| Polymer | 65 |
| Sodium sulphate | 17 |
| Acid silica | 17.5 |
| Acrylic acid | 0.5 |

The two components are then dry mixed at a ratio of 99 parts by weight spray dried powder to 1 part fabric rebuild granule.

Example 6

Detergent Granulate Prepared by Non-Spray Drying Method, Dry Mixed with Fabric Rebuild Granule The following composition was prepared by the two-stage mechanical granulation method described in EP-A-367 339.

| Component | % w/w |
|---|---|
| NaPAS | 13.5 |
| Dobanol 25-7 | 2.5 |
| STPP | 45.3 |
| Na Carbonate | 4.0 |
| Na Silicate | 10.1 |
| Minors | 1.5 |
| Water | to 100% |

Fabric Rebuild Granule

| Component | % w/w |
|---|---|
| Polymer | 70 |
| Sodium sulphate | 17 |
| Citric acid | 12.5 |
| Sokalan CP45 | 0.5 |

The fabric rebuild granule and detergent granules were mixed at a weight ratio of 1:99.5.

Example 7

Detergent Granular Prepared by Non-Spray Drying Method Mixed with Fabric Rebuild Granule The following granule was prepared by mechanical granulation method as described in EP-A-0367339.

| Component | % w/w |
|---|---|
| NaPAS | 9.0 |
| Alcohol ethoxylate 7EO branched | 4.8 |

-continued

| Component | % w/w |
|---|---|
| Alcohol ethoxylate 3EO branched | 2.5 |
| Soap | 1.0 |
| Zeolite A24 (anhydrous) | 30.0 |
| Na citrate | 3.8 |
| Na carbonate | 10.0 |
| Na bicarbonate | 1.0 |
| Na silicate | 1.8 |
| Silicone oil | 0.5 |
| Dequest 2066 | 0.4 |
| Sodium percarbonate | 20.0 |
| TAED granule (83%) | 5.8 |
| Minors | 9.6 |

A granular detergent composition was prepared by mixing the NaPAS, ethoxylated alcohol, soap, zeolite, sodium citrate, sodium carbonate, sodium bicarbonate, sodium silicate in a high speed mixer/densifier as described in EP-A-0367339. Silicone oil, Dequest, sodium percarbonate and TAED granule were post-dosed to the resulting granulate.

Subsequently, a fabric rebuild granule was manufactured using a high speed mixer/granulator, by mixing the following components:

| Component | % w/w |
|---|---|
| Polymer | 65 |
| Sodium sulphate | 17 |
| Acid silica | 17.5 |
| Acrylic acid | 0.5 |

The detergent granulate and the fabric rebuild granule are then dry mixed at a ratio 96 parts to 4 parts by weight.

Raw Material Specification

| Component | Specification |
|---|---|
| NaPAS | |
| Dobanol 25-7 | C12–15 ethoxylated alcohol, 7EO, ex Shell |
| Zeolite | Wessalith P, ex Degussa |
| Zeolite A4 | ex Crosfield |
| STPP | Sodium Tri PolyPhosphate, Thermphos NW, ex Hoechst |
| Dequest 2066 | Metal chelating agent, ex Monsanto |
| Silicone oil | Antifoam, DB 100, ex Dow Corning |
| Lipolase | Type 100L, ex Novo |
| Savinase 16L | Protease, ex Novo |
| Sokalan CP5 | Acrylic/Melaic Builder Polymer ex BASF |
| SCMC | Sodium Carboxymethyl Cellulose |
| Minors | antiredeposition polymers, transition-metal scavengers/bleach stabilisers, fluorescers, antifoams, dye-transfer-inhibition polymers, enzymes, and perfume. |

What is claimed is:

1. A laundry treatment granule comprising:

(a) 50–90% by weight based on the granule of a water-soluble or water-dispersible rebuild agent for deposition onto a fabric during a laundry treatment process wherein the rebuild agent undergoes during the laundry treatment process, a chemical change by which change the affinity of the rebuild agent for the fabric is increased, said chemical change resulting in the loss or modification of one or more groups covalently bonded to be pendant to a polymeric backbone of the rebuild agent via an ester linkage, the ester-linked group(s) being selected from monocarboxylic acid esters, (b) 0.3–10% by weight based on the granule of acidic binder, and (c) 5–30% by weight based on the granule of neutral filler.

2. A granule according to claim 1, wherein the rebuild agent is selected from one or more materials of general formula (I):

(I)

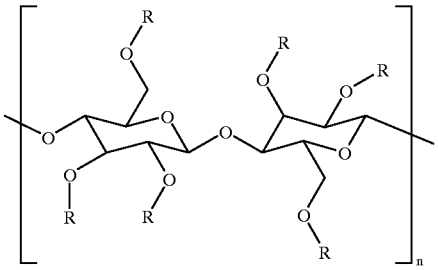

wherein at least one or more R groups of the polymer are independently selected from groups of formulae:

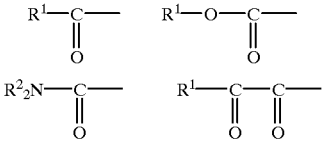

wherein each $R^1$ is independently selected $C_{1-20}$ alkyl, $C_{2-20}$ alkenyl and $C_{5-7}$ aryl any of which is optionally substituted by one or more substituents independently selected from $C_{1-4}$alkyl, $C_{1-12}$ alkoxy, hydroxyl, vinyl and phenyl groups; and each $R^2$ is independently hydrogen or a group as hereinbefore defined.

3. A granule according to claim 1, wherein the polymeric backbone of the rebuild agent comprises cellulose units or other β-1,4 linked polysaccharide units.

4. A granule according to claim 3, wherein the average degree of substitution of the total of all groups on the saccharide rings of the rebuild agent is from 0.4 to 3.

5. A granule according to claim 3, wherein the average degree of substitution of the total of all groups on the saccharide rings of the rebuild agent is from 0.4 to 1.

6. A granule according to claim 3, wherein the average degree of substitution of the total of all groups on the saccharide rings of the rebuild agent is from 0.5 to 0.75.

7. A granule according to claim 3, wherein the average degree of substitution of the total of all groups on the saccharide rings of the rebuild agent is from 0.6 to 0.7.

8. A granule according to claim 1, wherein the groups of the rebuild agent which undergo the chemical change are independently selected from one or more of acetate, propanoate, trifluoroacetate, 2-(2-hydroxy-1-oxopropoxy) propanoate, lactate, glycolate, pyruvate, crotonate, isovalerate, cinnamate, formate, salicylate, carbamate, methylcarbamate, benzoate and gluconate groups.

9. A according to claim 1, wherein the rebuild agent comprises cellulose monoacetate.

10. A granule according to claim 1, wherein the acidic binder comprises a polymeric material which is a homopolymer or copolymer of monomers selected from the group consisting of acrylic acid, methacrylic acid, ethacrylic acid, alpha-chloro-acrylic acid, crotonic acid, cinnamic acid, maleic acid, itaconic acid, citraconic acid, mesaconic acid, maleic acid, itaconic acid, citraconic acid, mesaconic acid, glutaconic acid, aconitic acid, fumaric acid and mixtures thereof.

11. A granule according to claim 1 wherein the neutral filler is selected from the group consisting of sodium sulphate, sodium acetate, sodium chloride and mixtures thereof.

12. A granule according to claim 1, further comprising 5–30% by weight of acidic filler.

13. A granular according to claim 12, wherein the acidic filler is selected from the group consisting of acidic silica and organic acids.

14. A process for manufacturing a granule according to claim 1, comprising the steps of mixing the rebuild agent, acidic binder and neutral filler and optionally acidic filler in a high speed mixer/granulator.

15. A detergent composition comprising a first granule comprising detergent active and a second granule, the second granule being according to claim 1.

16. A laundry treatment granule comprising:

(a) 50–90% by weight based on the granule of a water-soluble or water-dispersible rebuild agent for deposition onto a fabric during a laundry treatment process wherein the rebuild agent undergoes during the laundry treatment process, a chemical change by which change the affinity of the rebuild agent for the fabric is increased, the chemical change occurring in or to a group or groups covalently bonded to be pendant on a polymeric backbone of the rebuild agent and which backbone comprises cellulose units or other β-1,4 linked polysaccharide units, the average degree of substitution of the total of all groups pendant on the saccharide rings of the backbone being from 0.3 to 3.

(b) 0.3–10% by weight based on the granule of acidic binder, and (c) 5–30% based on the granule of neutral filler.

17. A composition according to claim 16, wherein the pendant group(s) of the rebuild agent comprise one or more groups attached via a respective linkage to the polymeric backbone.

18. A granule according to claim 16, wherein the rebuild agent is selected from one or more molecules of formula (II):

(II)

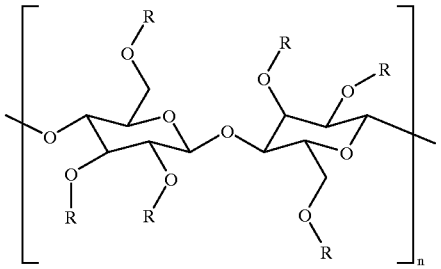

wherein at least one or more R groups of the polymer are independently selected from groups of formulae:

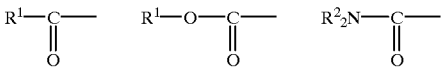

-continued

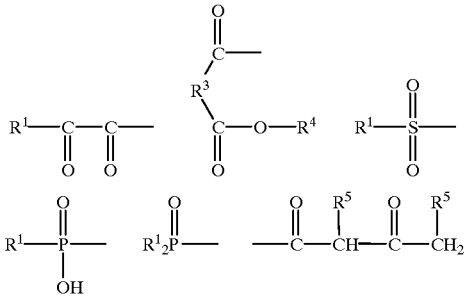

wherein each $R^1$ is independently selected from $C_{1-20}$ alkyl, $C_{2-20}$ alkenyl and $C_{5-7}$ aryl any of which is optionally substituted by one or more substituents independently selected from $C_{1-4}$ alkyl, $C_{1-12}$ alkoxy, hydroxyl, vinyl and phenyl groups;

each $R^2$ is independently selected from hydrogen and groups $R^1$ as hereinbefore defined;

$R^3$ is a bond or is selected from $C_{1-4}$ alkylene, $C_{2-4}$ alkenylene and $C_{5-7}$ arylene groups, the carbon atoms in any of these being optionally substituted by one or more substituents independently selected from $C_{1-12}$ alkoxy, vinyl, hydroxyl, halo and amine groups;

each $R^4$ is independently selected from hydrogen, counter cations such as alkali metal or ½ Ca or ½ Mg, and groups $R^1$ as hereinbefore defined;

wherein each $R_5$ is independently selected from the group consisting of H, $C_1$–$C_{20}$ alkyl, $C_5$–$C_7$ cycloalkyl, $C_7$–$C_{20}$ arylalkyl, $C_7$–$C_{20}$ alkylaryl, substituted alkyl, hydroxyalkyl, $(R_6)_2$N-alkyl, and $(R_6)_3$N-alkyl, where $R_6$ is independently selected from the group consisting of H, $C_1$–$C_{20}$ alkyl, $C_5$–$C_7$ cycloalkyl, $C_7$–$C_{20}$ arylalkyl, $C_7$–$C_{20}$ alkylaryl, aminoalkyl, alkylaminoalkyl, dialkylaminoalkyl, piperidinoalkyl, morpholinoalkyl, cycloaminoalkyl and hydroxyalkyl; and groups R which together with the oxygen atom forming the linkage to the respective saccharide ring forms an ester or hemi-ester group of a tricarboxylic- or higher polycarboxylic- or other complex acid such as citric acid, an amino acid, a synthetic amino acid analogue or a protein.

19. A granule according to claim 16, wherein at least some of the groups of the rebuild agent which undergo the chemical change are selected from one or more independently selected methanesulphonate and toluene sulphonate groups and hemiester groups of fumaric, malonic, itaconic, oxalic, maleic, succinic, tartaric, glutamic, aspartic and malic acids.

20. A granule according to claim 16, wherein the average degree of substitution of the total of all groups pendant on the saccharide rings of the backbone is from 0.4 to 0.1.

21. A granule according to claim 16, wherein the average degree of substitution of the total of all groups pendant on the saccharide rings of the backbone is from 0.5 to 0.75.

22. A granule according to claim 16, wherein the average degree of substitution of the total of all groups pendant on the saccharide rings of the backbone is from 0.6 to 0.7.

* * * * *